United States Patent [19]

Schuetz

[11] Patent Number: 4,840,598

[45] Date of Patent: Jun. 20, 1989

[54] AMUSEMENT PROJECTILE DEVICE

[76] Inventor: Robert W. Schuetz, Rt. 2, Box 125-J, Beckley, W. Va. 25801

[21] Appl. No.: 120,955

[22] Filed: Nov. 16, 1987

[51] Int. Cl.[4] ..... A63H 33/20

[52] U.S. Cl. ..... 446/52; 446/49

[58] Field of Search ..... 446/51, 52, 53, 54, 446/49, 50

[56] References Cited

U.S. PATENT DOCUMENTS

| | | | |
|---|---|---|---|
| 676,838 | 6/1901 | Dawson | 446/51 |
| 728,251 | 6/1903 | Lawrence | 446/51 |
| 757,247 | 4/1904 | Altermatt | 446/51 |
| 1,649,374 | 11/1927 | La Von Zundel et al. | 446/51 |
| 1,775,299 | 9/1930 | Warner | 446/51 |
| 1,835,717 | 12/1931 | Moore | 446/52 |
| 1,938,931 | 12/1933 | Newman | 446/51 |
| 2,559,458 | 7/1951 | Orr | 446/52 |
| 2,732,657 | 1/1956 | Krautkramer | 446/56 |
| 2,997,809 | 8/1961 | Gladen | 446/52 |
| 3,014,308 | 12/1961 | Parris | 446/52 |
| 3,084,477 | 4/1963 | Whatley | 446/50 |
| 3,175,327 | 3/1965 | Wend | 446/51 |
| 3,177,612 | 4/1965 | Giossi | 446/64 |
| 3,233,360 | 2/1966 | Poplin | 446/51 |
| 3,415,010 | 12/1968 | Belz | 446/52 |
| 3,445,954 | 5/1969 | Wahl | 446/52 |
| 3,465,472 | 9/1969 | Novotny | 446/52 |
| 4,356,662 | 11/1982 | Strasser et al. | 446/52 |

FOREIGN PATENT DOCUMENTS 363444 2/1939 Italy .

*Primary Examiner*—Robert A. Hafer
*Assistant Examiner*—Sam Rimell
*Attorney, Agent, or Firm*—Laubscher, Presta & Laubscher

[57] ABSTRACT

An amusement projectile device includes a hollow body and head and tail portions, characterized in that the hollow body is formed of a pair of body sections hinged together at one end for movement between closed and open positions. The body includes a pair of fins connected with the body sections adjacent the tail portion to assist in flight of the projectile device through the air. A plurality of colored streamers and a parachute connected with the body of the device are arranged in the hollow body with the body sections in the closed position. The projectile device is propelled into the air in the closed position. At the apex of its flight, the body sections open releasing the streamers and the parachute. The streamers randomly flutter to the ground and the projectile floats to the ground while suspended from the parachute providing amusement to the user.

4 Claims, 1 Drawing Sheet

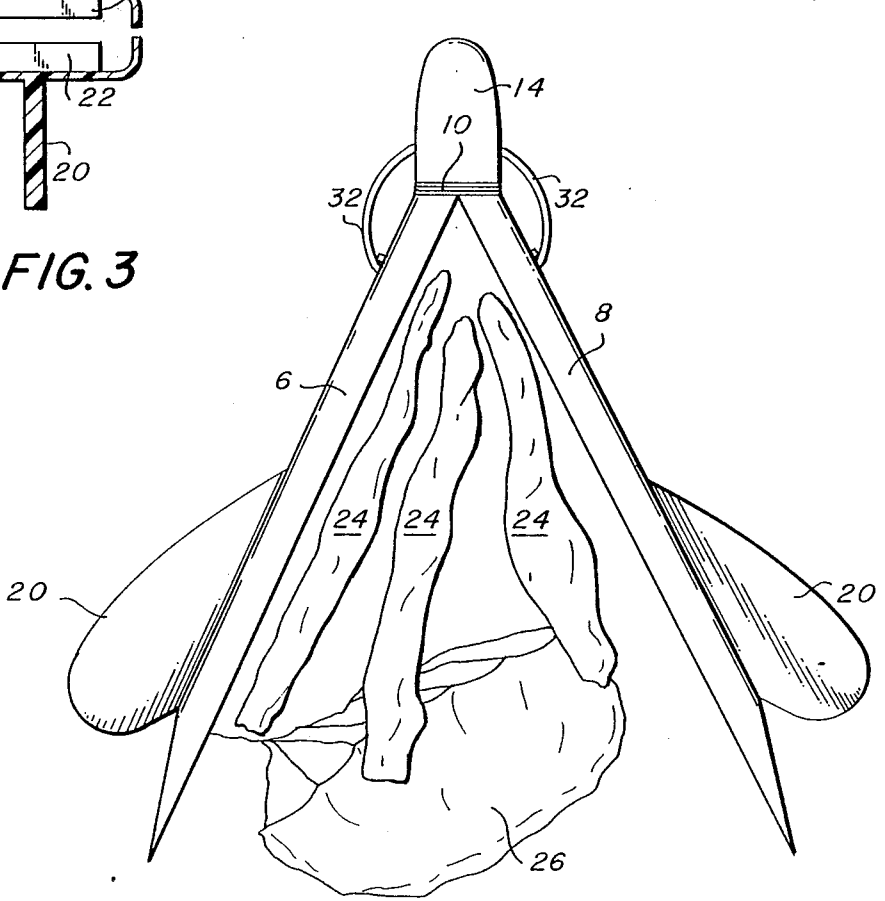
FIG. 3
FIG. 4
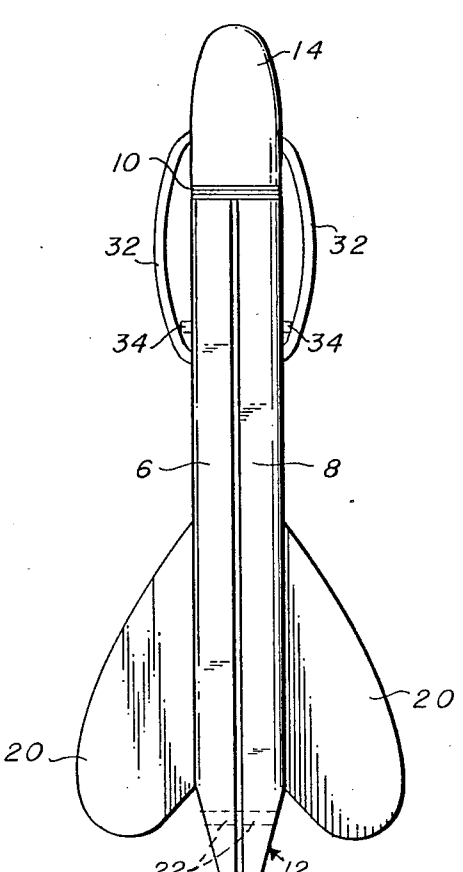
FIG. 2
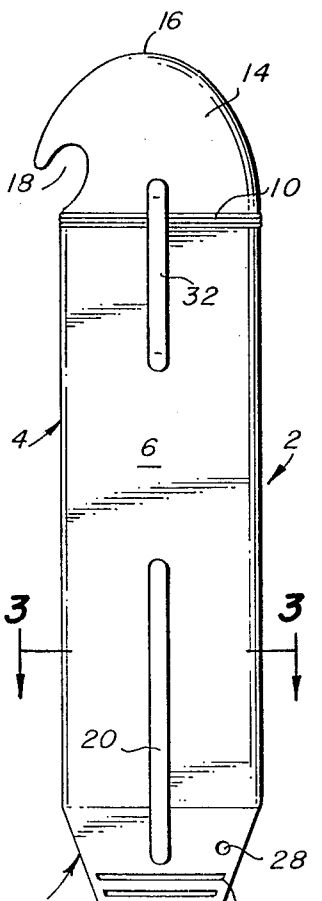
FIG. 1

AMUSEMENT PROJECTILE DEVICE

BACKGROUND OF THE INVENTION

The present invention relates to a reusable projectile device for propelling colored streamers into the air for amusement purposes. As the streamers fall randomly to the ground, the are caught by participants in a game to accumulate points. The device is safe and economical to manufacture, and is easy to use by people of all ages.

BRIEF DESCRIPTION OF THE PRIOR ART

Prior toy projectiles typically have a cylindrical configuration with a pointed top or forward end and a parachute connected with the bottom or rearward end. A large rubber band is used to propel the projectile into the air which then drops back to the ground while suspended from the parachute.

While the prior projectiles normally operate satisfactorily, they are somewhat dangerous when used by young children owing to the pointed end. Moreover, the prior devices are limited in versatility since they are only useful for repeated projection into the air and floating back to the ground. Other prior toy projectiles are more complex to manufacture and use, making them difficult to operate and more likely to break.

The present invention was developed in order to overcome these and other drawbacks of the prior toy projectiles by providing an economical and safe projectile affording a far greater degree of exercise and amusement than is provided by the prior devices.

SUMMARY OF THE INVENTION

Accordingly, it is a primary object of the present invention to provide an amusement projectile device including an elongated generally rectangular hollow body including a pair of longitudinal sections hinged together at one end for movement between open and closed positions. The other end of each longitudinal section is tapered to define a tail portion of the body. Connected with the hinged end of the body sections is a head portion having a concave top surface and containing a recess in one side surface thereof defining a projection portion for propelling the device into the air. A pair of fins is connected with the body sections adjacent the tail portion thereof to assist in the flight of the device through the air. A plurality of streamers are arranged within the hollow body when the body sections are in the closed position. With the sections closed, the projectile device is propelled into the air. When the device reaches the apex of its flight path, the sections move to the open position to release the streamers from within the body, thereby allowing the streamers and the body to fall randomly to the ground.

According to a further object of the invention, an elastic member is connected between the head portion and the body sections of the projectile device to assist the movement of the body sections from the closed to the open position.

It is yet another object of the invention to provide a parachute connected with the projectile body, the parachute being contained within the hollow body when the body sections are in the closed position and being released from within the hollow body when the sections move to the open position.

According to another object of the invention, each body section includes an interior extension in the tail portion thereof to retain the streamers and the parachutes within the body while the body sections are in the closed position.

BRIEF DESCRIPTION OF THE FIGURES

Other objects and advantages of the invention will become apparent from a study of the following specification when viewed in the light of the accompanying drawing, in which:

FIGS. 1 and 2 are front and side plan views, respectively, of the projectile device according to the invention in its closed position;

FIG. 3 is a sectional view of the body of the projectile device taken along line 3—3 of FIG. 1;

FIG. 4 is a side plan view of the projectile device in its open position.

DETAILED DESCRIPTION

Referring first to FIG. 1, the amusement projectile device 2 according to the invention is shown. The device includes an elongated hollow body 4 having a generally rectangular transverse cross-sectional configuration as shown in FIG. 3. The body comprises a pair of body sections 6, 8 each having a generally U-shaped cross sectional configuration. The body sections are connected at their upper ends by a corrugated neck portion 10 of the body which acts as a hinge. The sections are thus movable between a closed position shown in FIGS. 1–3 wherein the sections are parallel and adjacent each other, thereby defining the rectangular configuration of the projectile body, and an open position shown in FIG. 4 wherein the sections are spaced from each other. The lower ends of the body sections are tapered to define a tail portion 12 as will be developed in greater detail below.

Extending upwardly from the corrugated neck 10 of the body is a head portion 14 having a concave top surface 16 and containing a recess 18 in one side surface thereof. The head portion 14 of the projectile device is preferably solid and weighted more heavily than the hollow body to provide better flight of the projectile device through the air. The blunt or concave surface 16 is aerodynamically designed for optimum flight while providing added safety over prior devices since the blunt surface is less likely to pierce or puncture another object of person.

A pair of fins or stabilizers 20 is connected with the projectile body 4 adjacent the tail portion 12 thereof. More particularly, one fin extends exteriorly from the center of each body section 6, 8 as shown in FIGS. 1 and 3. The fins further enhance the flight path of the projectile through the air.

The head portion 14, body sections 6, 8, tail section 12, and fins 20 are preferably formed as a single element which is molded or the like from synthetic plastic material which affords flexibility at the corrugated neck portion enabling the body sections to move between open and closed positions.

Extending inwardly from the tail portion of each body section is an integral exension member 22 as best shown in FIG. 3. The extensions assist in closing the hollow body when the body sections are in the closed position as will be developed in greater detail below.

Arranged within the hollow body are a plurality of streamers 24 or strips of synthetic plastic material as shown in FIG. 4. Each streamer is preferably formed in a different color of fluorescent material such as MYLAR. Also arranged within the hollow body is a parachute 26 which is connected with an opening 28 contained in one of the body sections.

The exterior surfaces of the body sections 6, 8 at the tail portion 12 of the projectile device preferably contain a plurality of grooves 30 to improve the gripping surface thereof.

With the streamers 24 and parachute 26 arranged within the hollow body 4 and the body sections 6, 8 in their closed position, the extensions 22 retain the streamers and parachute within the projectile body. The user of the device grips the tail portion 12 of the projectile body with one hand and inserts an elastic member such as a large rubber band (not shown) in the recess in the head portion 14. The user then pulls the tail portion downwardly while aiming the head portion upwardly to stretch the elastic member. By letting go of the tail portion 12, the projectile is propelled into the air up to a distance of thirty feet or more. During the upward portion of its flight, the body remains in its closed position owing to the pressure forces exerted on the body.

When the projectile device reaches the apex of its flight, the body sections 6 and 8 move toward the open position since the closing pressure forces from upward flight are minimized. Simultaneously, the projectile device begins to invert owing to the heavier weight of the head portion 14, whereby the head portion is subsequently directed downwardly. When the body sections open, the streamers and parachute are released from within the hollow body. The streamers fall or flutter randomly to the ground, much like falling leaves, to provide amusement to the user. Moreover, the parachute fills the air with the projectile device suspended therefrom, whereby the projectile device gently falls to the ground.

For greater amusement and exercise, one or more participants may play a game by trying to catch the streamers before they touch the ground. Different points may be assigned to different colored streamers, and points may be accumulated by the players in accordance with the streamers caught upon successive launchings of the projectile device.

To assist in movement of the body sections from their closed to their open positions, one or more elastic members such as rubber bands 32 is connected between the head portion 14 and the body sections 6, 8. For example, the body sections may include protruding hooks 34 about which an end or loop of the elastic member is arranged, with the other end of the elastic member passing through an opening (not shown) in the head portion. Thus when the projectile device reaches the apex of its flight and the pressure closing forces exerted on the body sections are minimized, the elastic members pull the body sections apart to their open positions.

The projectile device of the present invention is thus simple and economical to manufacture and easy to operate, even by the very young. Moreover, it is safe and reusable, providing hours of trouble-free amusement.

While in accordance with the provisions of the patent statue the preferred forms and embodiments of the invention have been illustrated and described, it will be apparent to those of ordinary skill in the art that various changes and modifications may be made without deviating from the inventive concepts set forth above.

What is claimed is:

1. An amusement projectile device, comprising (a) a longitudinal hollow body having a generally rectangular transverse cross sectional configuration, said body comprising a pair of longitudinal sections defining a cavity and hinged together at one end for movement between a closed position wherein said sections are adjacent one another and an open position wherein said sections are spaced from one another, the other ends of said body sections defining a tapered tail portion;

(b) a head portion connected with said hollow body adjacent the hinged connection of said body sections, said body having a convex top surface and containing a recess in one side surface thereof defining a projection portion for propelling the devices into the air;

(c) elastic biasing means connected between said head portion and said body sections to assist movement of said sections from the closed to the open position when the device is propelled into the air;

(d) first and second fins conneced with said body sections, respectively, adjacent said tail portion to assist in the flight of the device; and (e) a plurality of streamer means arranged within said hollow body cavity, whereby with said body sections in the closed position, said body is propelled into the air and when said body reaches the apex of its flight path, said biasing means move said body sections to the open position to release said streamer means from said body cavity, said streamer means and said body falling randomly to the ground.

2. A projectile device as defined in claim 1, and further comprising a parachute connected with said body, said parachute being arranged within said hollow body when it is in the closed position and being released therefrom when said body sections move to the open position.

3. A projectile device as defined in claim 2, wherein each of said body sections includes an interior extension in the tail portion thereof to retain said streamer means and said parachute within said body during launch and the ascending portion of the projectile flight.

4. A projectile device as defined in claim 3, wherein said streamer means comprise colored strips of synthetic plastic material.

* * * * *